United States Patent [19]

Löfving

[11] Patent Number: 4,797,507

[45] Date of Patent: Jan. 10, 1989

[54] OUTLET BOX PROVIDED WITH COAXIAL CONNECTORS

[75] Inventor: Stig-Arne Löfving, Nykköping, Sweden

[73] Assignee: Thorsman & Co. Aktiebolag, Stockholm, Sweden

[21] Appl. No.: 25,141

[22] PCT Filed: May 21, 1986

[86] PCT No.: PCT/SE86/00235

§ 371 Date: Feb. 10, 1987

§ 102(e) Date: Feb. 10, 1987

[87] PCT Pub. No.: WO86/07202

PCT Pub. Date: Dec. 4, 1986

[30] Foreign Application Priority Data

May 23, 1985 [SE] Sweden ..... 8502563-3

[51] Int. Cl.[4] ..... H01R 13/516

[52] U.S. Cl. ..... 174/48; 174/52.1; 439/572

[58] Field of Search ..... 174/48, 49, 50, 52 R; 439/571, 572

[56] References Cited

U.S. PATENT DOCUMENTS

| | | | |
|---|---|---|---|
| 2,968,690 | 1/1961 | Higgins | 174/48 X |
| 3,353,068 | 11/1967 | Turk | 174/52 R X |
| 3,571,771 | 3/1971 | Stephanson | 174/50 X |
| 4,370,516 | 1/1983 | Bailey et al. | 174/48 X |

*Primary Examiner*—Arthur T. Grimley
*Assistant Examiner*—David A. Tone
*Attorney, Agent, or Firm*—Roberts, Spiecens & Cohen

[57] ABSTRACT

A coaxial outlet box which is intended to be mounted on a wall, an electrical conduit front or like support surface and which can be fastened directly to the support surface or to a conventional conduit box recessed in the surface. The outlet box includes a frame-like base plate (2); a connector holder plate (5) which is arranged at right angles to the base plate adjacent a straight edge thereof and in which one or more coaxial connectors are arranged parallel with the support surface; and a hood-like cover (1) which is constructed to protect the connection of the connectors (6) with the associated cables (7). An opening in the cover side wall (10) provides access to the connector or connectors (6) for connection to respective cables.

12 Claims, 2 Drawing Sheets

OUTLET BOX PROVIDED WITH COAXIAL CONNECTORS

FIELD OF THE INVENTION

The present invention relates to an outlet box, provided with coaxial connectors preferably intended for mounting onto an outer wall-surface, an electrical conduit front or like surface, either separately or in conjunction with a recessed junction box.

BACKGROUND PRIOR ART

As a result of the progressively increasing use of computerized equipment, data processors and the like, more and more office locations, so-called office environments, are being fitted with coaxial outlet boxes. Depending upon the age of the building concerned, the cables leading to the outlet box are either located on outer wall-surfaces, drawn through installation conduits or trunking embodied in the walls of the building, or encased in cable ducts. Irrespective of the cable lay-out used, the coaxial cable to be connected to a coaxial terminal connector is led into a junction box, which may be either a surface mounted box or a recessed box, in which the cable is connected to a terminal connector arranged in the box cover, so as to project at right angles to the wall or the conduit front, whereafter the relevant data or terminal cable is connected to the terminal connector. Due, inter alia, to its inflexibility, the data or terminal cable, when connected, projects outwardly from the outlet box into the room in which it is fitted, thereby exposing the cable to the risk of damage as a result of heavy impacts, blows or like forces to which the cable may be inadvertently subjected when, for example, rearranging furniture in the room concerned, moving desks, chairs, tables, etc.

In order to improve to some extent the facilities for connection of data and terminal cables to the supply net, box covers have been produced which are partially accomodated in the outlet box, the box cover being provided with a center part in which the terminal connectors are located at 45° to the plane of the cable inlet of the box. Although this modification has been found to be an improvement and has reduced the risk of damage to data cables connected to the outlet box, it has resulted in less space in the box for bending and manipulating the ends of the incoming coaxial cable when connecting said ends to respective terminal connectors, thereby rendering the task more difficult.

In order to provide more space within the outlet box, a further type of box cover has been proposed in which the terminal connectors are arranged on one side of a shoulder or rib which extends across the box cover and slopes at an angle of 45° at said one side. Although a box cover of this construction has more internal space, difficulty is still found in bending the incoming coaxial cable for connection to the terminal connectors.

SUMMARY OF THE INVENTION

The object of the present invention is to provide an outlet box provided with coaxial connectors which can be used universally, by which is meant that the outlet box can be used either separately or in conjunction with conduit boxes, and therewith enable the terminal connectors to be located parallel with a wall or conduit front, so as to lessen the risk of damage to the cable connections to the greatest possible extent and, at the same time, to provie in the box sufficient space for bending the incoming cables along a radius which will enable the cables to be connected readily and comfortably to the terminal connectors. A further object is to provide an outlet box so constructed as to enable fibre optic cables to be connected safely to junction devices intended herefor. These objects are realized with the present invention by means of an outlet box having the features set forth hereafter.

BRIEF DESCRIPTION OF THE DRAWINGS

An embodiment of an outlet box according to the invention will now be described in more detail with reference to the accompanying drawings, in which.

DESCRIPTION OF AN EXEMPLIFYING EMBODIMENT

Figure 1:
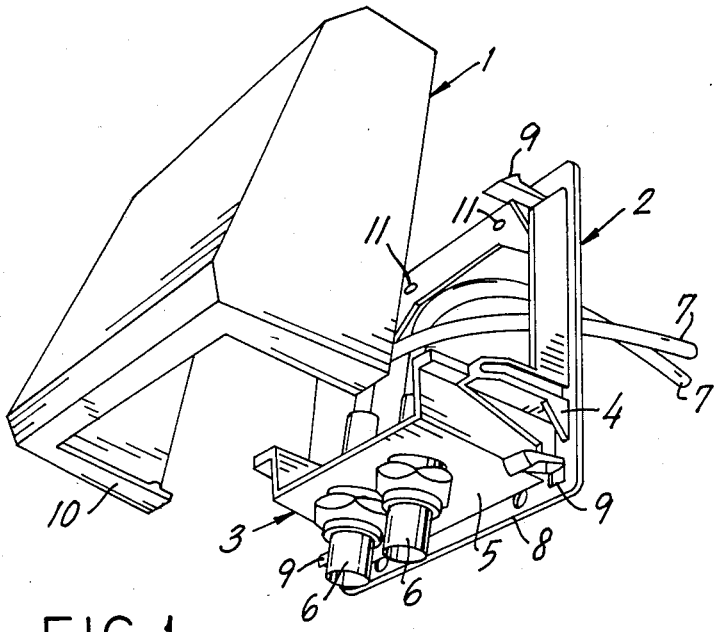
FIG. 1 is a perspective view of an outlet box with the cover removed.
Figure 2:
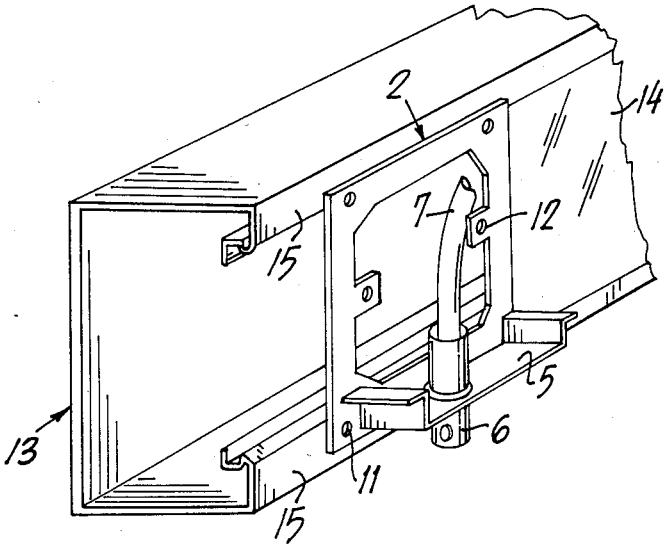
FIG. 2 is a perspective view, schematically illustrating the base plate of an outlet box fitted to the front surface of an electric trunking section.

In FIG. 1, which illustrates in perspective an exemplifying embodiment of the outlet box with the cover lifted off, the reference numeral 1 identifies the hood-like cover of the outlet box, while the reference numeral 2 identifies the base plate thereof, said base plate having the form of a square frame. Projecting forwardly in the vicinity of the bottom edge 8 of the base plate 2 are two brackets or ledges 3,4 in which guide grooves for an exchangeable connector holder plate 5 are arranged at right angles to the base plate, the holder plate 5 of the FIG. 1 embodiment carrying two coaxial connectors 6 which are connected to coaxial cables 7 entering through the cable opening provided in the base plate 2. The cover 1 is secured to the base plate 2 by means of hooks 9 provided on the base plate. The base plate 2 is also provided with screw holes 11,12 for fastening the plate to a support surface. Two of the screw holes, 12, are located a standard distance apart normal in conduit box fittings, so that the outlet box can be used in conjunction with conventional junction boxes. Located in the bottom part 10 of the side wall of the cover 1 is a cut-out or recess through which the connectors 6 fitted to the connector holder plate 5 can be reached for connecting cable connections, not shown. As beforementioned, the outlet box can be mounted directy onto the front surface of a trunking section or electrical conduit without requiring the use of a recessed junction box within the trunking, such junction boxes normally being otherwise required. This is made possible by the fact that the outlet box is so constructed that the part of the coaxial terminal connector 6 intended for connection to the incoming coaxial cable is fully enclosed within the box and is so positioned or oriented as to enable the section of cable entering the box from the trunking section to be readily guided into the box, which means that when increasing the extent of the cable in the electric trunking there is no risk of the coaxial cable in question being subjected to forces or stresses which might jeopardize the safety of the connection, and consequently the need for the protection afforded by a junction box positioned in the trunking section no longer exists. FIG. 2 illustrates schematically both a part of a conventional electric cable trunking section 13 and a base plate 2 mounted on the front wall thereof. The illustrated trunking 13 comprises a U-shaped channel section, the front wall of said section presenting mutually facing, folded leg portions 15. Other types of outlets may be placed in the opening located between the mutually facing leg portions 15. The cables, not shown, drawn through the trunking, can also be reached through the opening defined by said leg portions. Those parts of the opening which are not used are closed by means of front cover strips 14, of which one is shown to the right of the base plate 2.

Figure 3:
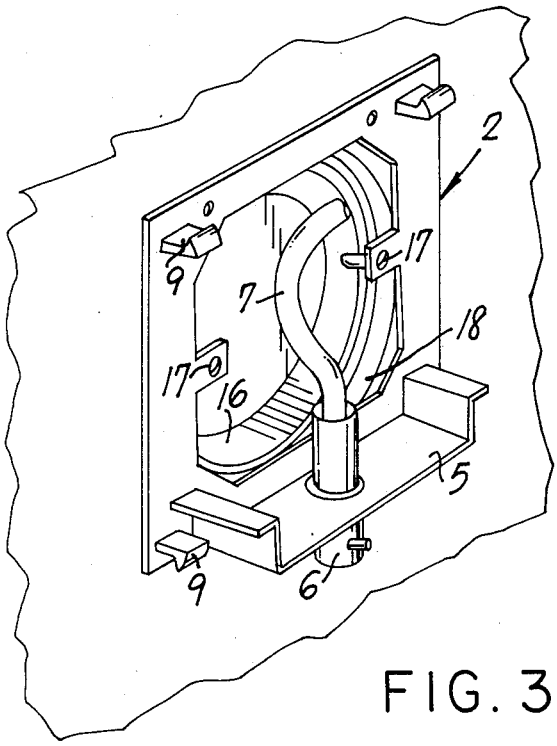
FIG. 3 is a schematic illustration of the base plate of an outlet box mounted on a junction box which is fitted in a wall recess.

FIG. 3 is a schematic illustration of a base plate 2 fitted on a conventional junction box 16, the base plate being fastened to the attachment ring 18 of the junction box by means of screws 17. This fitting also enables the terminal connector 6 to be placed on the connector holder plate 5 so that the incoming coaxial cable 7 can be connected with a radius of curvature sufficiently large to ensure that the operation of the cable is not jeopardized.

Figure 4:
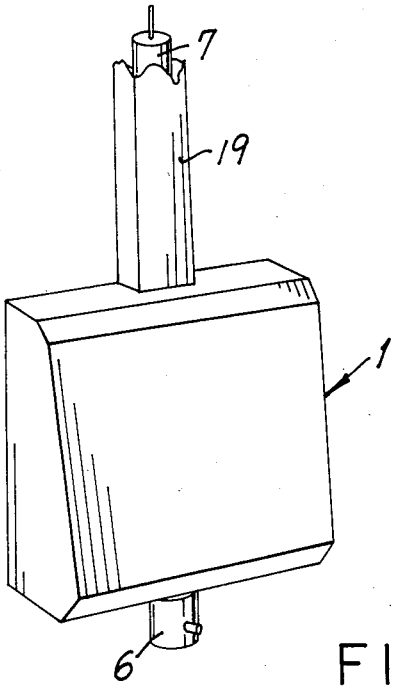
FIG. 4 illustrates a surface mounted outlet box, where the incoming cable is drawn through surface mounted channelling.

FIG. 4 illustrates an outlet box mounted on the surface of a wall, the incoming cable 7 being drawn through a conduit 17, the end plane of which lies against the cover 1. The cable enters the cover through an opening made therein by removing a fracturable part of the cover provided specifically for this purpose. When used in this way, the outlet box provides the best possible conditions for connecting the cable to the connector 6.

There are many different types of commercially available coaxial connectors of mutually different design which, for their attachment, require the provision of holes of different shapes and sizes. Because the coaxial connectors illustrated in FIG. 1 are attached to a separate, replaceable connector holder plates, the outlet box can be readily adapted to a selected type of connector, by simply replacing the holder plate, the purpose of which is to keep down manufacturing and storage costs, and also handling costs.

As seen in FIGS. 1–3, the holder plate 5 projects perpendicularly at the front of base plate 2 below the opening in the base plate which occupies a major portion thereof. The opening in the base plate forms narrow strips in the base plate at the top, bottom and sides thereof. The holder plate is located adjacent to the strip at the bottom of the base plate and is composed of a flat wall which supports connectors 6 and upstanding side wings which are slidably engaged in the guide grooves in the brackets 3, 4.

I claim:

1. An outlet box for a coaxial connector, adapted for mounting on a wall, on a conduit channel section or on a recessed junction box in which the coaxial connector is arranged parallel to the underlying support surface, comprising a base plate mountable on a support surface, and a hood-shaped cover detachably mountable on the base plate to protect said plate and any components located thereon, said base plate including a frame having at least one straight edge and a central opening occupying a substantial portion of the base plate for passage of a cable such that when the base plate is fitted on a junction box recessed in a wall the opening in the junction box is substantially exposed to enable the coaxial cable to be bent along a sufficiently large radius in order to minimize damage to the cable, said base plate including two brackets projecting forwardly from said frame and having guide grooves extending substantially at right angles to the base plate, a replaceable connector holder plate slidably mounted in said guide grooves, at least one connector on said holder plate for attachment of said cable thereto, said base plate including means for detachable connection with said hood-like cover, said cover being provided with a recess through which said connector is accessible when the cover is connected to said base plate.

2. An outlet box as claimed in claim 1 wherein said frame is provided with holes for attachment fasteners.

3. An outlet box as claimed in claim 2 wherein two of said holes are located centrally in said frame and are spaced a determined distance apart for attachment to a junction box.

4. An outlet box as claimed in claim 2 wherein said frame and said opening are substantially rectangular.

5. An outlet box as claimed in claim 4 wherein said cover is tapered and has a first end wall of greater depth than an opposite second end wall, said recess being in said first end wall.

6. An outlet box as claimed in claim 5 wherein said cover is secured to said base plate with the second end wall at the top and the first end wall at the bottom, said connector being accessible through said recess in said first end wall from therebelow.

7. An outlet box as claimed in claim 6 wherein said second end wall has a fracturable part to form an opening through which a cable can enter for connection to said connector.

8. An outlet box as claimed in claim 1 wherein said connector extends substantially parallel to said base plate in the said holder plate mounted on said brackets.

9. An outlet box as claimd in claim 8 wherein said connector projects below said holder plate and through said recess in said cover.

10. An outlet box as claimed in claim 1 wherein said means on said base plate for detachable connection with said hood comprises a plurality of members with hooks projecting from said base plate.

11. An outlet box as claimed in claim 1 wherein said opening on the frame occupies a major portion of the base plate and defines narrow strips at the top, bottom and sides of the frame, said holder plate being supported by said brackets at the narrow strip at the bottom of the frame below said opening.

12. An outlet box as claimed in claim 11 wherein said holder plate includes a flat wall extending perpendicularly to said base plate and upstanding side wings slidably engaged in said guide grooves.

* * * * *